US010646745B2

(12) United States Patent
Crowley et al.

(10) Patent No.: US 10,646,745 B2
(45) **Date of Patent: *May 12, 2020**

(54) FOOT PLATFORM AND REBOUNDING DEVICE AND METHOD OF USING SAME

(71) Applicant: Total Gym Fitness, LLC, Exton, PA (US)

(72) Inventors: Joseph Crowley, West Chester, PA (US); Thomas J. Campanaro, Rancho Santa Fe, CA (US); Dan McCutcheon, San Diego, CA (US)

(73) Assignee: Total Gym Fitness, LLC, Exton, PA (US)

( * ) Notice: Subject to any disclaimer, the term of this patent is extended or adjusted under 35 U.S.C. 154(b) by 134 days.

This patent is subject to a terminal disclaimer.

(21) Appl. No.: 15/841,996

(22) Filed: Dec. 14, 2017

(65) Prior Publication Data

US 2018/0104532 A1 Apr. 19, 2018

Related U.S. Application Data

(63) Continuation of application No. 15/140,876, filed on Apr. 28, 2016, now Pat. No. 9,901,772.
(Continued)

(51) Int. Cl.
*A63B 22/00* (2006.01)
*A63B 21/068* (2006.01)
(Continued)

(52) U.S. Cl.
CPC ..... *A63B 22/0087* (2013.01); *A63B 21/068* (2013.01); *A63B 22/0023* (2013.01); *A63B 22/205* (2013.01); *A63B 71/0054* (2013.01); *A63B 21/00069* (2013.01); *A63B 21/4033* (2015.10); *A63B 21/4034* (2015.10); *A63B 21/4045* (2015.10); *A63B 22/0056* (2013.01);
(Continued)

(58) Field of Classification Search
CPC ..... A63B 22/0087; A63B 22/205; A63B 71/0054; A63B 22/0023; A63B 21/068; A63B 21/4033; A63B 2023/0411; A63B 23/0405; A63B 23/03525; A63B 22/0056; A63B 69/0028; A63B 2071/0063; A63B 21/4045; A63B 21/4034; A63B 21/00069
See application file for complete search history.

(56) References Cited

U.S. PATENT DOCUMENTS 3,992,023 A * 11/1976 Moorer ..... A61G 5/00 280/87.021
4,492,374 A * 1/1985 Lekhtman ..... A63B 25/10 267/28

(Continued)

*Primary Examiner* — Garrett K Atkinson
(74) *Attorney, Agent, or Firm* — Procopio Cory Hargreaves and Savitch LLP

(57) ABSTRACT

An inclinable rebounding exercise device comprising at least one inclinable rail having an upper and a lower end; an adjustable support assembly that allows the at least one rail to be adjusted to a desired inclination angle; a sliding platform slidably mounted with respect to the at least one rail; a support base; a foot platform assembly including a pair of resilient, independent foot platforms coupled to the support base. The pair of resilient, independent foot platforms allow for a soft landing achieved by absorbing energy therein, reducing joint stress and allowing greater muscle exercise.

18 Claims, 10 Drawing Sheets

Related U.S. Application Data

(60) Provisional application No. 62/185,190, filed on Jun. 26, 2015.

(51) Int. Cl.

| | |
|---|---|
| ***A63B 71/00*** | (2006.01) |
| ***A63B 22/20*** | (2006.01) |
| ***A63B 21/00*** | (2006.01) |
| ***A63B 69/00*** | (2006.01) |
| ***A63B 23/035*** | (2006.01) |
| ***A63B 23/04*** | (2006.01) |

(52) U.S. Cl.

CPC ..... *A63B 23/03525* (2013.01); *A63B 23/0405* (2013.01); *A63B 69/0028* (2013.01); *A63B 2023/0411* (2013.01); *A63B 2071/0063* (2013.01)

(56) References Cited

U.S. PATENT DOCUMENTS 4,534,124 A * 8/1985 Schnell ..... A43B 13/18 36/114
4,535,985 A * 8/1985 Mask ..... A63B 21/0628 482/138
4,722,520 A * 2/1988 Lee ..... A63B 22/0076 482/112
4,912,859 A * 4/1990 Ritts ..... A43B 13/184 36/7.8
5,138,776 A * 8/1992 Levin ..... A43B 13/183 36/27
5,169,363 A * 12/1992 Campanaro ..... A63B 21/068 482/96
5,205,798 A * 4/1993 Lekhtman ..... A43B 13/18 482/121
5,263,913 A * 11/1993 Boren ..... A63B 21/068 482/132
5,554,085 A 9/1996 Dalebout
5,643,148 A * 7/1997 Naville ..... A43B 13/183 482/124
5,722,922 A 3/1998 Watterson et al.
D405,132 S * 2/1999 Westfall ..... D21/676
5,916,071 A * 6/1999 Lee ..... A43B 13/182 482/124
5,967,955 A * 10/1999 Westfall ..... A63B 21/068 482/142
6,027,429 A 2/2000 Daniels
6,042,523 A * 3/2000 Graham ..... A63B 21/0552 482/121
6,106,439 A 8/2000 Boland
D431,615 S * 10/2000 Webber ..... D21/675
6,436,012 B1 * 8/2002 Naville ..... A43B 5/00 36/114
6,500,099 B1 * 12/2002 Eschenbach ..... A63B 21/152 482/121
7,179,207 B2 * 2/2007 Gerschefske ..... A63B 5/00 482/95
7,270,628 B2 * 9/2007 Campanaro ..... A63B 21/068 482/95
7,322,907 B2 1/2008 Bowser
7,427,257 B1 9/2008 Chernet
7,455,629 B2 * 11/2008 Abelbeck ..... A63B 21/078 482/101
7,597,656 B2 * 10/2009 Trees ..... A61H 1/0229 482/142
7,740,563 B2 6/2010 Dalebout et al.
7,771,328 B2 * 8/2010 Gerschefske ..... A63B 5/00 482/27
7,775,936 B2 8/2010 Wilkinson
7,874,971 B2 * 1/2011 Reyes ..... A63B 23/04 482/130
D635,205 S * 3/2011 Thulin ..... D21/676
7,901,338 B2 * 3/2011 Gerschefske ..... A63B 5/00 482/142
8,033,971 B2 * 10/2011 Campanaro ..... A63B 21/068 482/142
8,323,157 B2 * 12/2012 Campanaro ..... A63B 23/03533 482/132
8,480,548 B2 * 7/2013 Gerschefske ..... A63B 5/00 482/96
8,617,033 B2 * 12/2013 Stewart ..... A63B 22/0046 482/77
8,696,528 B2 4/2014 Campanaro et al.
8,702,575 B2 * 4/2014 McVay ..... A63B 21/068 482/142
8,721,506 B2 * 5/2014 Gerschefske ..... A63B 5/00 482/96
9,227,106 B2 * 1/2016 Richards ..... A63B 23/0405
9,656,118 B2 * 5/2017 Campanaro ..... A63B 22/205
9,750,973 B1 * 9/2017 Yang ..... A61H 3/0288
2002/0083616 A1 * 7/2002 Hajianpour ..... A43B 13/182 36/7.8
2004/0204294 A2 10/2004 Wilkinson et al.
2004/0266586 A1 12/2004 Palmer
2006/0252609 A1 * 11/2006 Abelbeck ..... A63B 21/078 482/92
2007/0117696 A1 * 5/2007 Gerschefske ..... A63B 5/11 482/142
2009/0163323 A1 * 6/2009 Bocchicchio ..... A63B 21/068 482/8
2010/0087295 A1 4/2010 Crawley, IV
2012/0077653 A1 3/2012 Dedov
2014/0194260 A1 * 7/2014 Campanaro ..... A63B 21/068 482/131
2015/0246263 A1 * 9/2015 Campanaro ..... A63B 23/03566 482/52

* cited by examiner

FOOT PLATFORM AND REBOUNDING DEVICE AND METHOD OF USING SAME

This application is a continuation of U.S. patent application Ser. No. 15/140,876, filed on Apr. 28, 2016, which claimed priority to Provisional Patent Application No. 62/185,190 filed Jun. 26, 2015 all of the above which are incorporated by reference herein.

FIELD OF THE INVENTION

The present invention relates, in general, to a foot platform for an exercise device, and, in particular to separate foot platforms for an exercise device including a glide board.

SUMMARY OF THE INVENTION

An aspect of the invention involves an inclinable rebounding exercise device comprising at least one inclinable rail having an upper and a lower end; an adjustable support assembly that allows the at least one rail to be adjusted to a desired inclination angle; a sliding platform slidably mounted with respect to the at least one rail; a support base; a foot platform assembly including a pair of resilient, independent foot platforms coupled to the support base. The pair of resilient, independent foot platforms allow for a soft landing achieved by absorbing energy therein, reducing joint stress and allowing greater muscle exercise.

Another aspect of the invention involves a method of using the inclinable rebounding exercise device of the aspect of the invention described immediately above. The method comprising the steps of adjusting the at least one rail at a desired incline using the adjustable support assembly; laying one's back on the sliding platform with one's head near the upper end of the at least one inclinable rail; supporting each of one's feet on each of the foot platforms; and bending and extending at least one of one's legs, pushing off of at least one of the foot platforms with at least one of one's feet to move one's torso with and on the sliding platform whereby at least one of the resilient, independent foot platforms provide a springy, resilient feel when the user presses and bounces off the foot platform with at least one foot.

A further aspect of the invention involves a foot platform assembly for an exercise device comprising a pair of resilient, independent foot platforms, and the pair of resilient, independent foot platforms allow for a soft landing achieved by absorbing energy therein, reducing joint stress and allowing greater muscle exercise.

One or more implementations of the aspects of the invention described above includes one or more of the following: the support base includes a base support tube with a pair of tubular sockets, and the foot platform assembly includes reduced-diameter strut tubes that received by the pair of tubular sockets, the foot platform assembly includes a spring support tube that the pair of resilient, independent foot platforms are resiliently mounted to, and larger-diameter strut tubes that couple the spring support tube to the reduced-diameter strut tubes, each foot platform includes a H-shaped tubing support assembly with H-shaped support blades, each foot platform includes a front foot platform member and a rear foot platform member, one of the front foot platform member and the rear foot platform member includes includes a centrally disposed rectangular mounting section and the other of the front foot platform member and the rear foot platform member includes a centrally disposed rectangular hole that receives the rectangular mounting section for mounting the the front foot platform member and the rear foot platform member together, the front foot platform member includes a front with with treads to engage one's feet during use, the foot platform assembly includes a spring support and springs that resiliently mount the pair of resilient, independent foot platforms are to the spring support, and the springs are a pair of leaf springs; pushing off of at least one of the foot platforms with at least one of one's feet includes contacting both foot platforms simultaneously with one's feet; pushing off of at least one of the foot platforms with at least one of one's feet includes using only one foot on the foot platform assembly at a time, as opposed to two feet contacting both foot platforms simultaneously; pushing off of at least one of the foot platforms with at least one of one's feet includes alternating foot contact with the foot platforms whereby one foot contacts one foot platform followed by the other foot contacting the other foot platform, in a stepping motion; varying resistance when pushing off of at least one of the foot platforms with at least one of one's feet by adjusting the incline of the at least one rail using the adjustable support assembly; pushing off of at least one of the foot platforms with at least one of one's feet includes performing at least one of the following exercises: a squat exercise, a bridge squat exercise, a plyometric squat exercise, sprinters, running, jogging, and walking; adjusting the incline of the at least one rail to a substantially horizontal orientation, and pushing off of at least one of the foot platforms with at least one of one's feet with the incline of the at least one rail in a substantially horizontal orientation.

DETAILED DESCRIPTION OF PREFERRED EMBODIMENT

Figure 1:
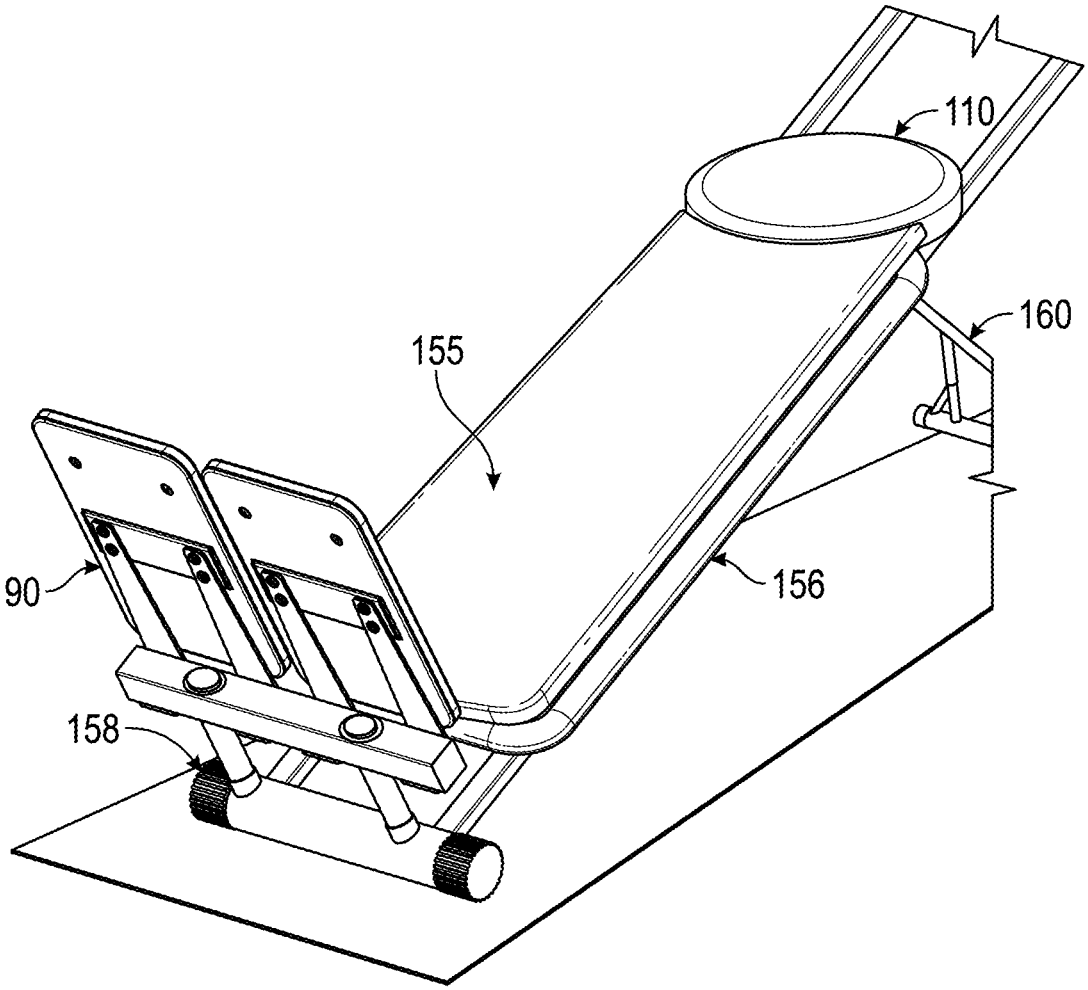
FIG. 1 is a perspective view of an embodiment of an exercise device including an embodiment of a pair of foot platforms.

With reference initially to FIGS. 1-16, an embodiment of a foot platform assembly 90 including a pair of foot platforms 100 for an exercise device 110 will be described. Although the foot platforms 100 will be described in connection with jumping and exercise on an inclined exercise device 110, in alternative embodiments, the pair of foot platforms 100 may be used in conjunction with horizontal exercise devices (e.g., Pilates exercise machines) and/or other types of exercise/physical therapy devices. Further, the pair of foot platforms 100 may be used with squat exercises or other exercises/therapies other than jumping.

The exercise device 110 comprises a sliding platform or glide board 155 slidably mounted on inclined rail(s) 156 which are secured to a base support tube 158 at their lower ends and are supported in desired inclined orientation at a selected inclination angle by an adjustable support assembly 160 that allows the rails 156 to be adjusted to a desired inclination angle.

Figure 2:
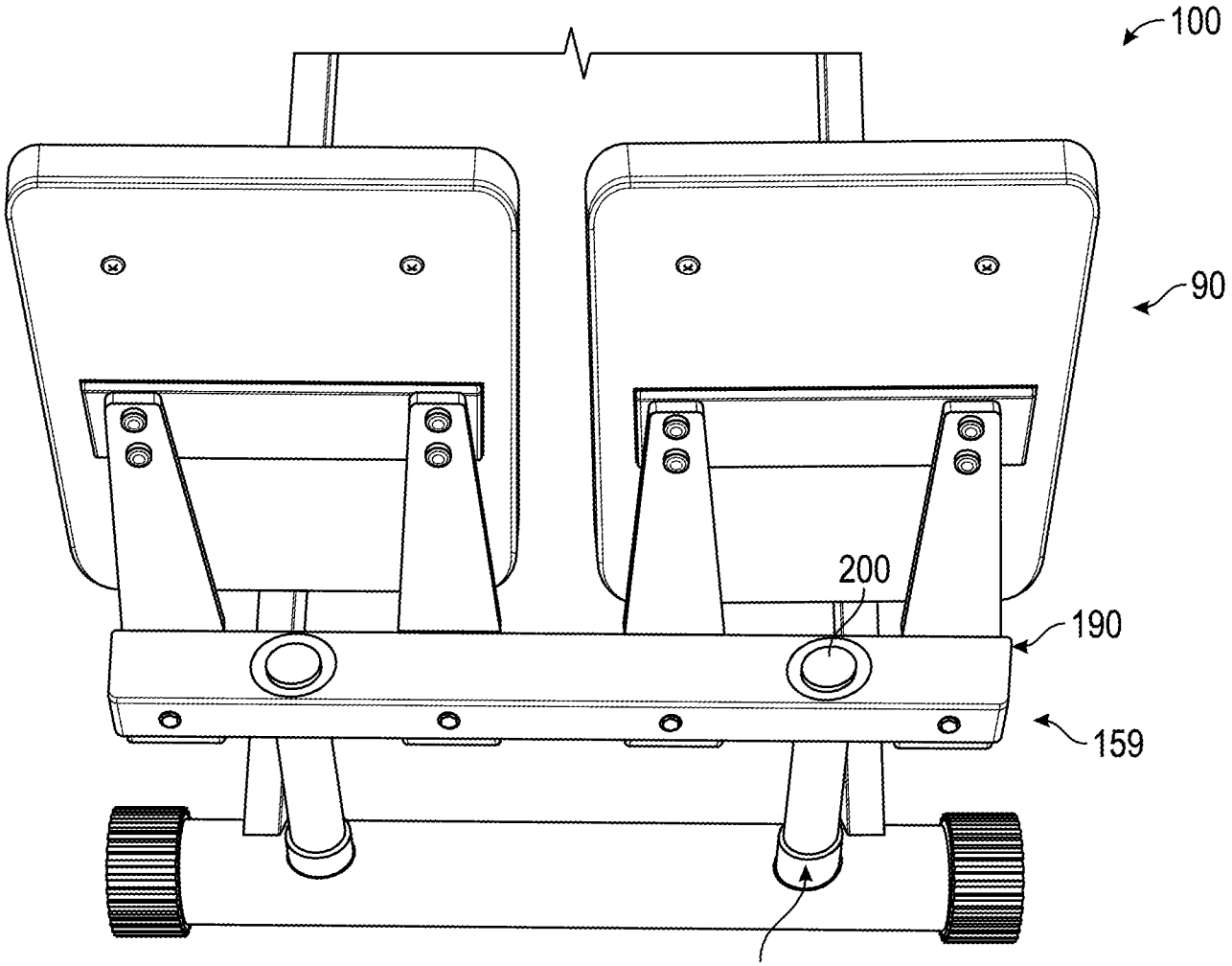
FIG. 2 is a rear elevational view of the pair of foot platforms of FIG. 1.
Figure 3:
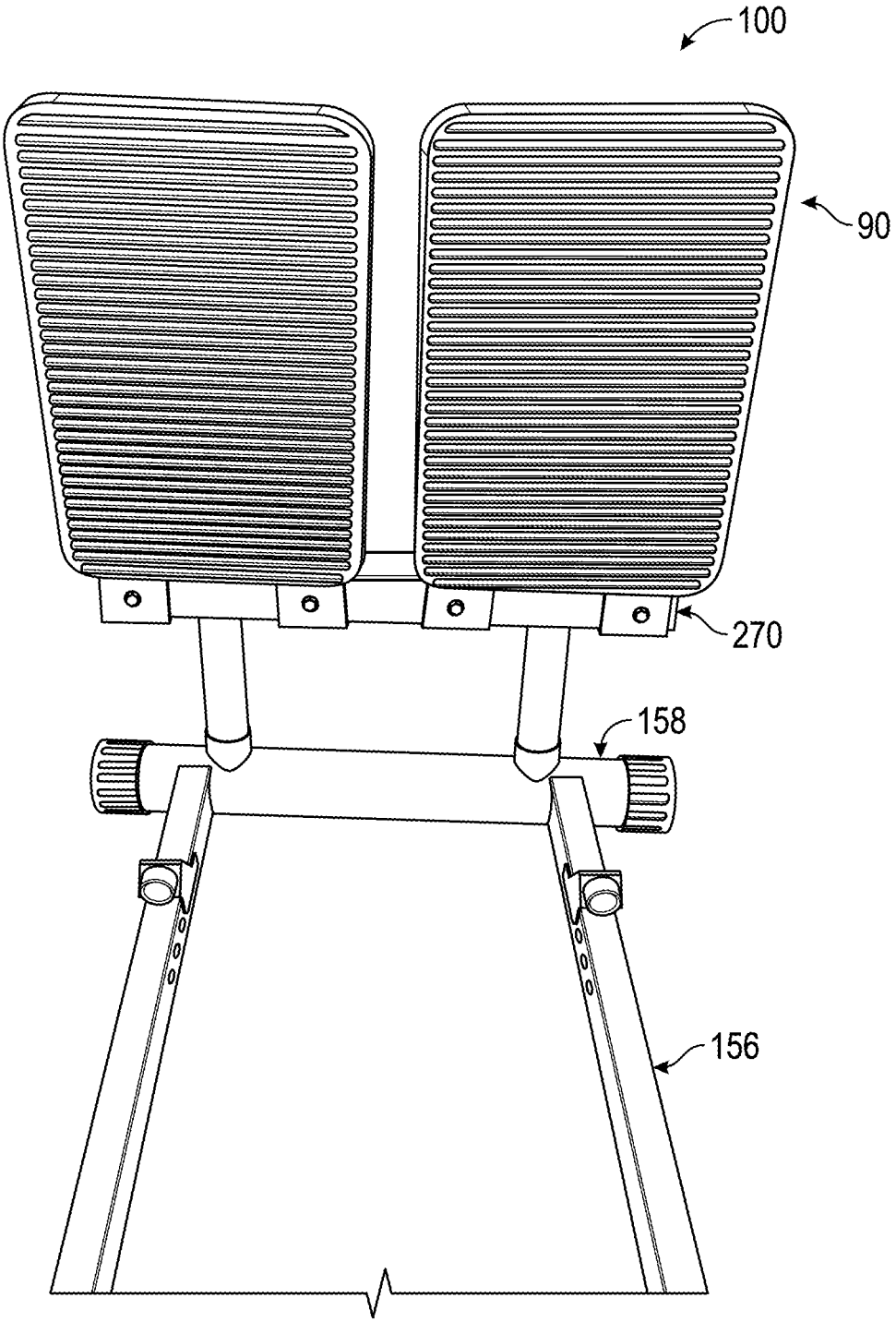
FIG. 3 is a front elevational view of the pair of foot platforms of FIG. 1.
Figure 4:
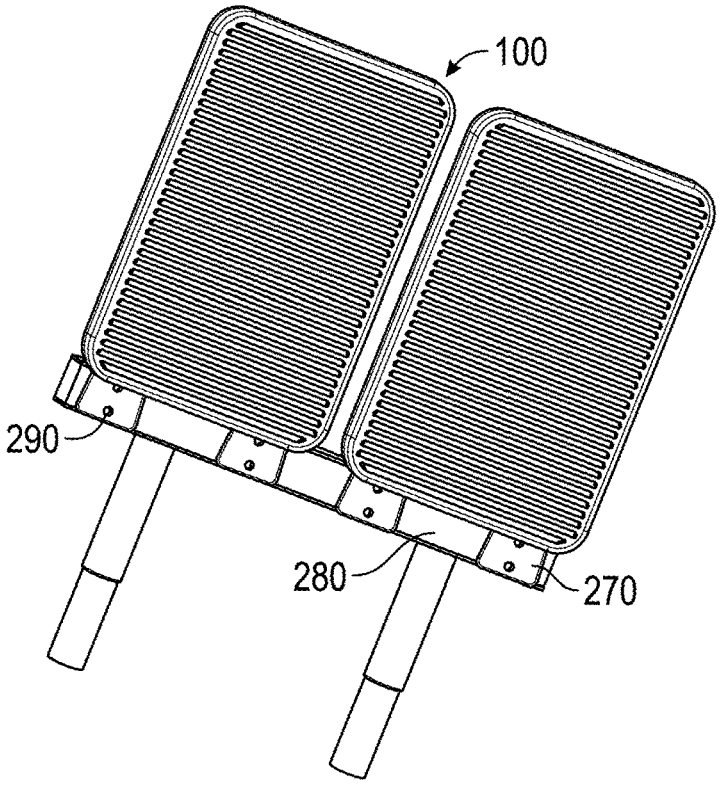
FIG. 4 is another front elevational view of the pair of foot platforms of FIG. 1.
Figure 5:
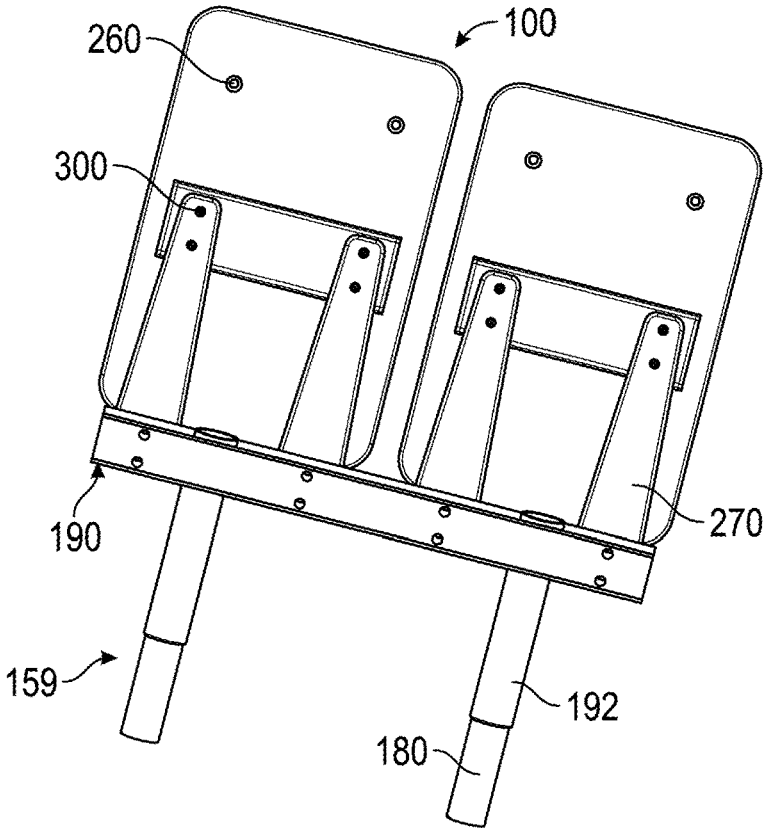
FIG. 5 is another rear elevational view of the pair of foot platforms of FIG. 1.
Figure 6:
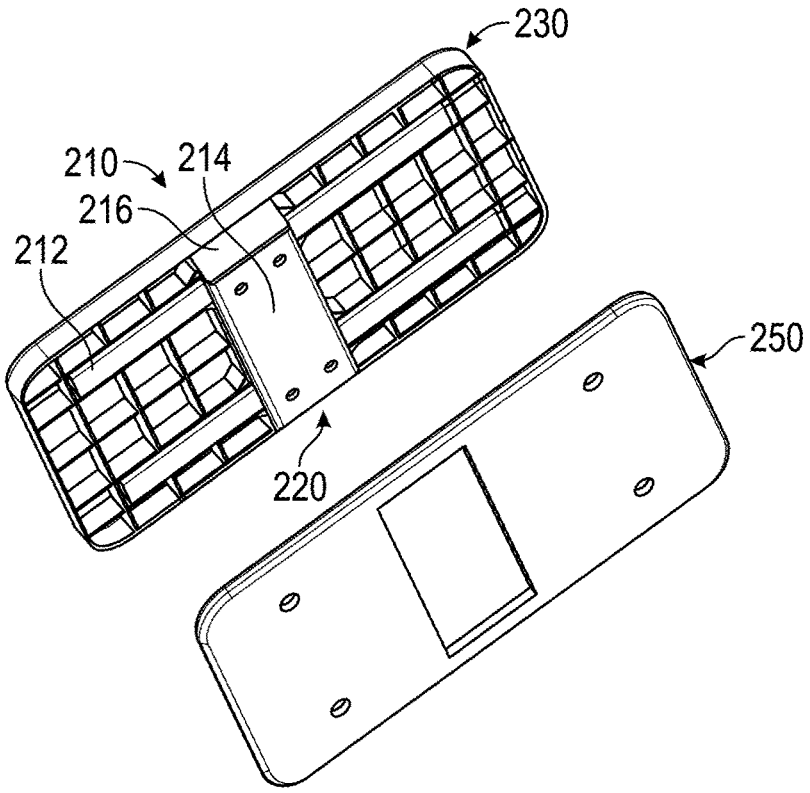
FIG. 6 is a rear perspective view of an exploded version of the foot platform of FIG. 1.
Figure 7:
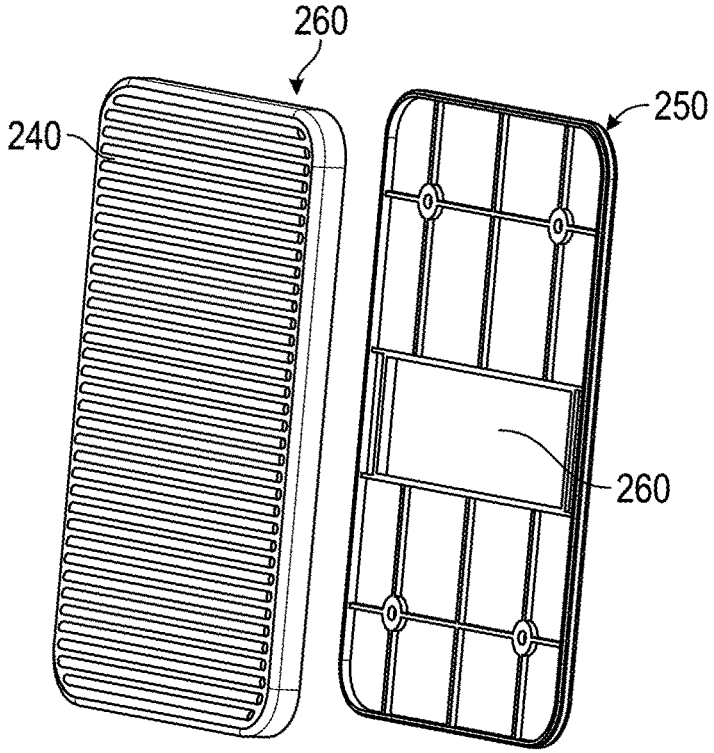
FIG. 7 is a front perspective view of an exploded version of the foot platform of FIG. 1.
Figure 8:
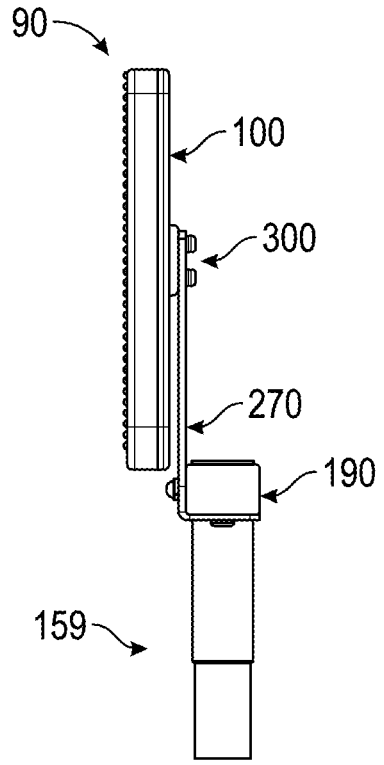
FIG. 8 is a right side elevational view of the foot platform of FIG. 1.
Figure 9:
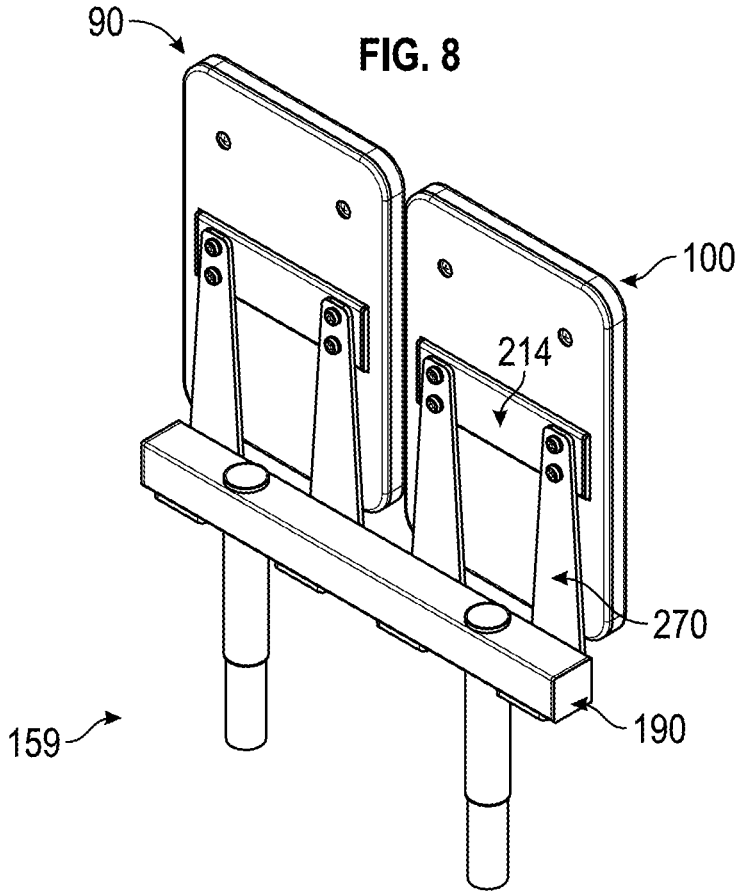
FIG. 9 is a rear perspective view of the pair of foot platforms of FIG. 1.
Figure 10:
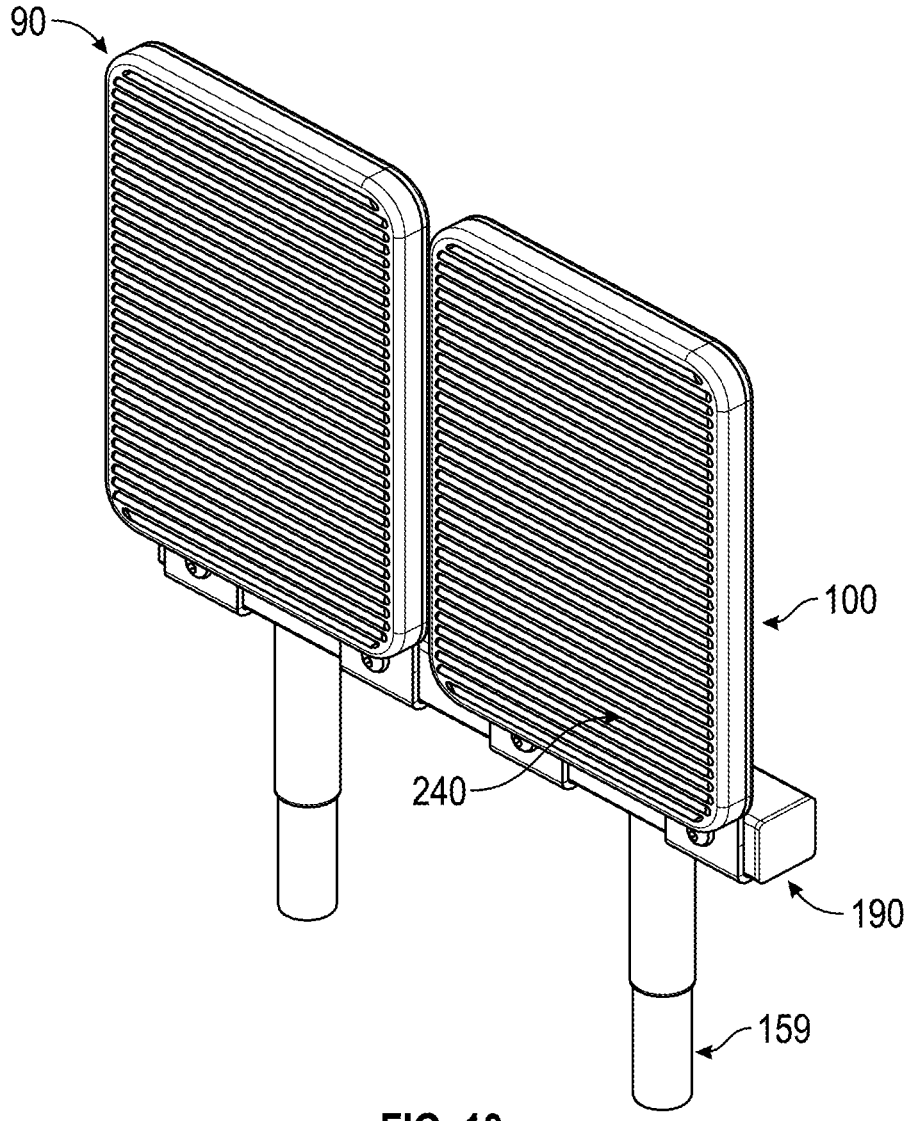
FIG. 10 is a front perspective view of the pair of foot platforms of FIG. 1.
Figure 11:
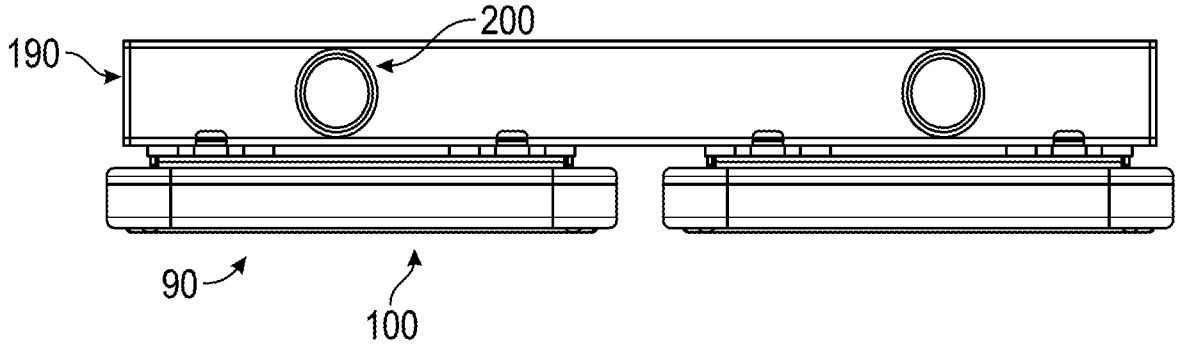
FIG. 11 is a top plan view of the pair of foot platforms of FIG. 1.
Figure 12:
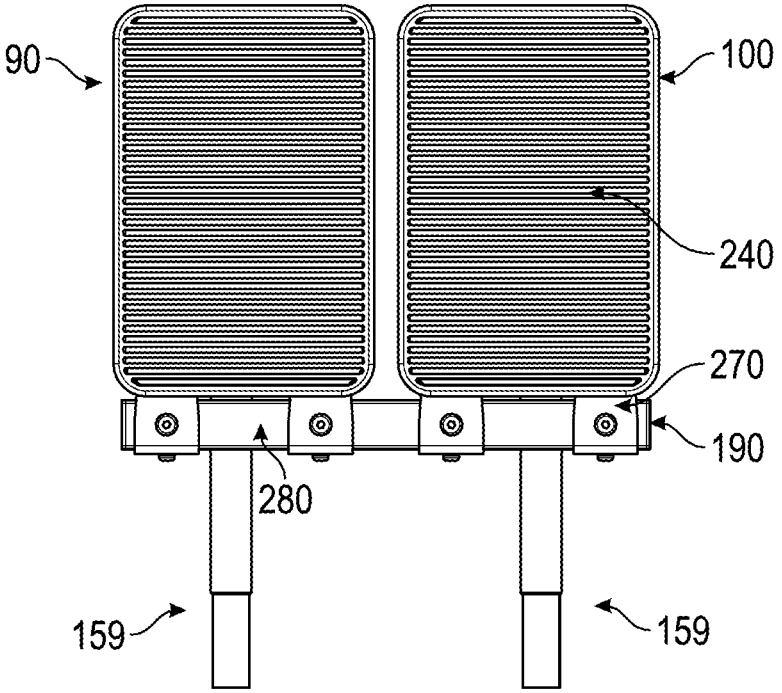
FIG. 12 is a front elevational view of the pair of foot platforms of FIG. 1.
Figure 13:
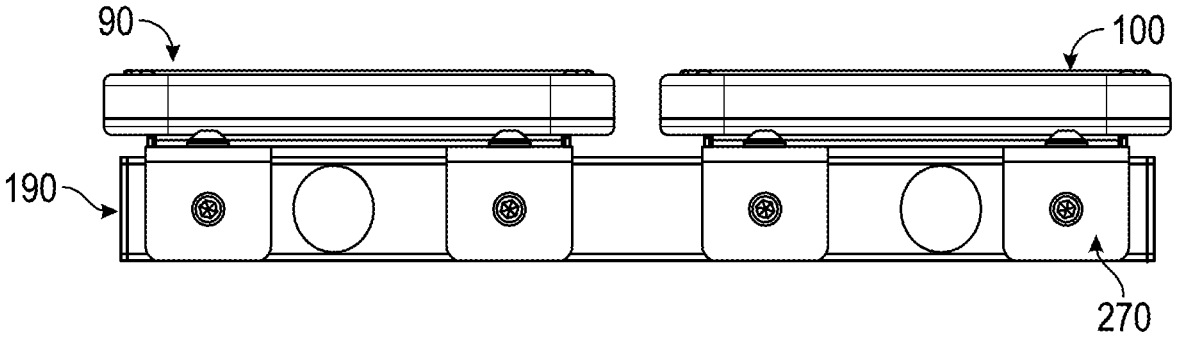
FIG. 13 is a bottom plan view of the pair of foot platforms of FIG. 1.
Figure 14:
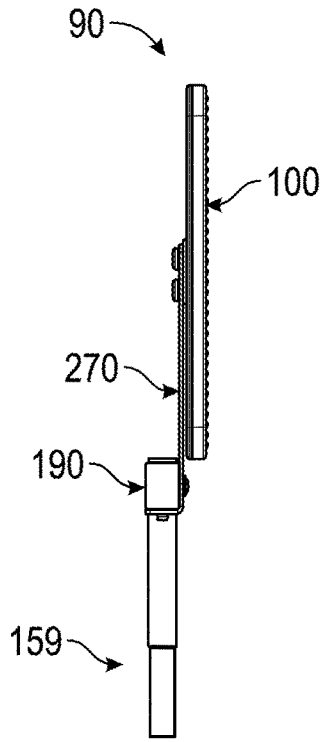
FIG. 14 is a left side elevational view of the pair of foot platforms of FIG. 1.
Figure 15:
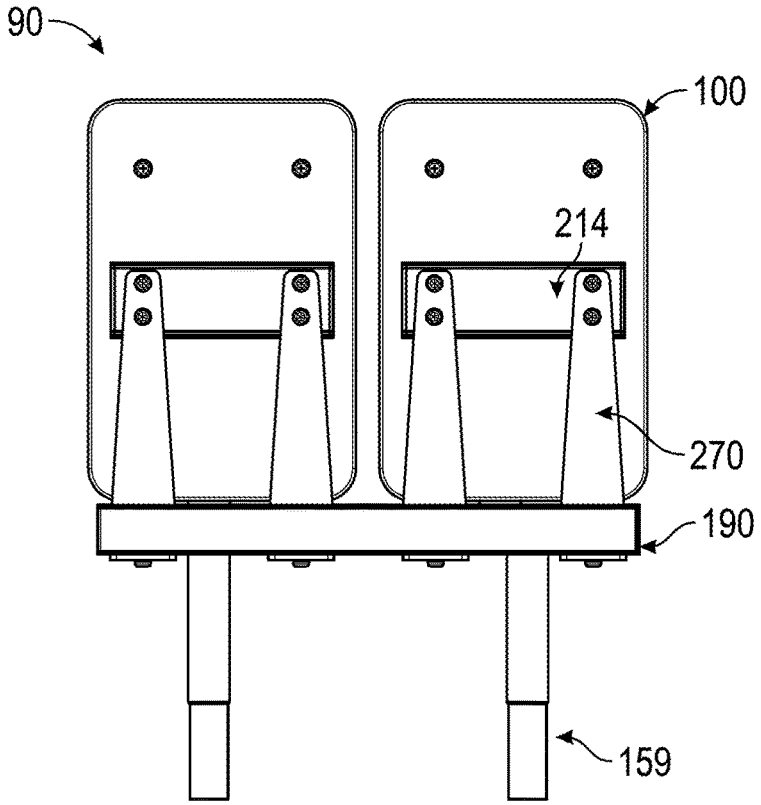
FIG. 15 is a rear elevational view of the pair of foot platforms of FIG. 1.
Figure 16:
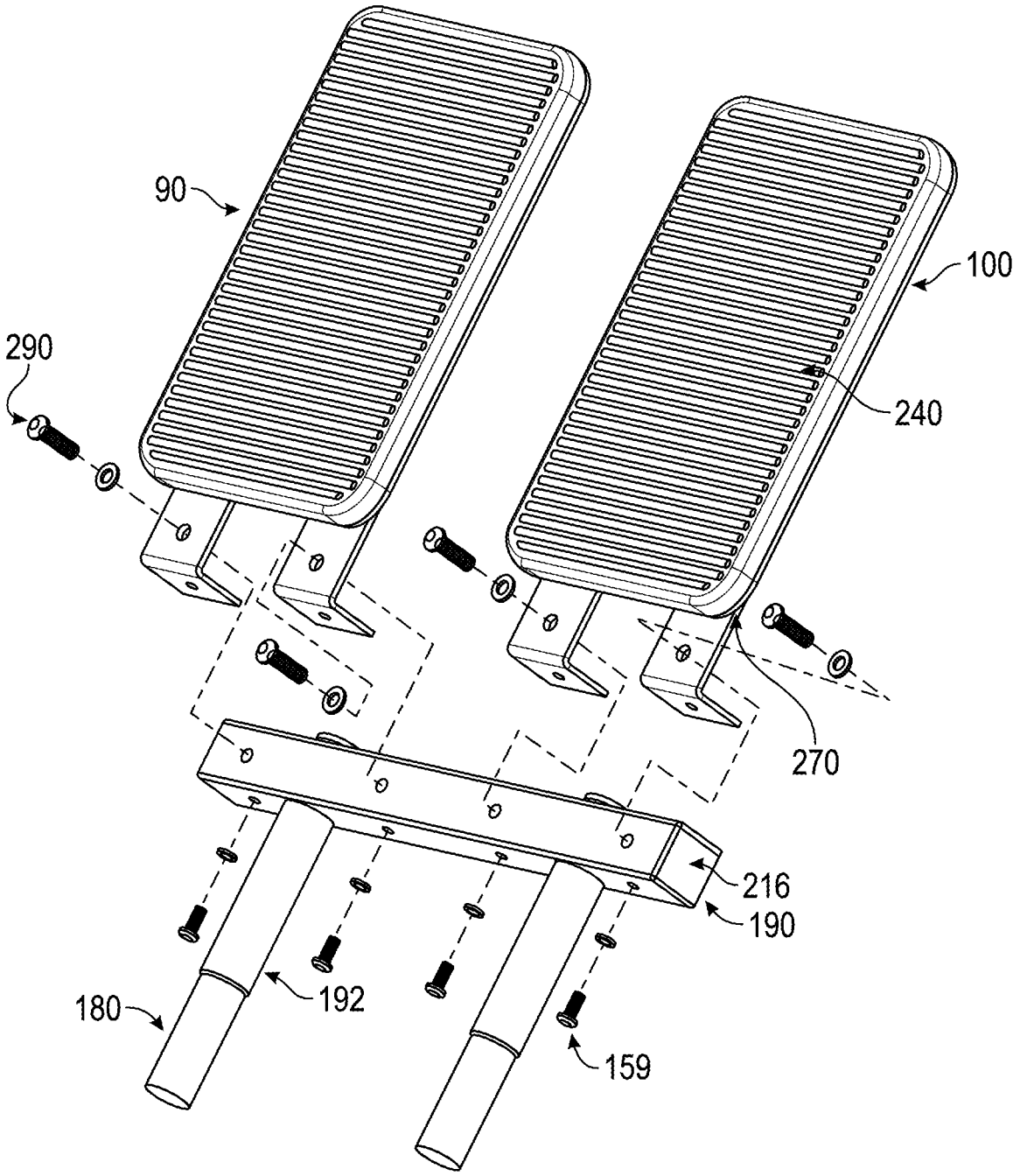
FIG. 16 is an exploded perspective view of the pair of foot platforms of FIG. 1.

With reference to FIGS. 2 and 3, the foot platforms 100 are mounted to the base support tube or support base 158 of a main frame assembly 159 adjacent to the lower ends of the foot platforms 100 via a pair tubular sockets 170. The tubular sockets 170 receive reduced-diameter strut tubes 180, which are coupled to spring support tube 190 via larger-diameter strut tubes 192. Round plastic tube caps 200 are used to cap the ends of the strut tubes 180 and square plastic tube caps are used to cap the opposite ends of the spring support tube 190.

With reference to FIGS. 2-16, the foot platforms 100 each include a H-shaped tubing support assembly 210 with H support blades 212, H support base tube 214, and plastic tube cap 216. The H support base tube 214 includes a centrally disposed rectangular mounting section 220. The H-shaped tubing support assembly 210 is connected to a rear of a rectangular plastic molded front foot platform member 230. An opposite side or front of the front foot platform member 230 includes treads 240 that one's feet engage during use. A rectangular plastic molded rear foot platform member 250 includes a centrally disposed rectangular hole 260 that receives the rectangular mounting section 220 of the H-shaped tubing support assembly 210. The rear foot platform member 250 is connected to the front foot platform member 230 via a plurality of threaded fasteners 260.

Two pairs of leaf springs 270 are connected at one end to a front face 280 of the spring support tube 190 with threaded fasteners 290 and are connected at an opposite end to centrally disposed rectangular mounting section 220 of the H-shaped tubing support assembly 210 with threaded fasteners 300.

The foot platform assembly 90 will now be described in use. With the rails 156 preferably at an incline, a user lies with one's back on the glide board 155 with one's head near a top of the inclined rails 156. The user puts the bottom of one's shoes/feet on the treads 240 of the foot platforms 100. The user bends and extends one's legs, pushing off of the foot platforms 100 with one's feet to move one's torso on the glide board 155. The individual, separate leaf springs 270 connected to the respective foot platforms 100 give each foot platform 100 a springy, resilient feel when the user presses and/or bounces off the foot platforms 100 with one's feet. Additional variations involve using only one foot on one foot platform (as opposed to two feet contacting both foot platforms 100 simultaneously), alternating contact of one foot on one foot platform followed by contacting another foot on the other foot platform, and/or positioning the foot/feet in various locations and/or orientations on each foot platform 100. To vary resistance when jumping or pressing off of the foot platform assembly 90, a user may vary the angle of the rails 156 with the adjustable support assembly 160. The steeper the angle of the rails 156, the greater the resistance and vice versa. Examples of exercises that can be performed on exercise device 110 using the foot platform assembly 90 include, but are not limited to, squat exercises, bridge squat exercises, plyometric squat exercise, sprinters, and/or other exercises/therapies. Although generally a user would use the exercise device 110 and the foot platform assembly 90 with the rails 156 in an inclined orientation, the user may use the exercise device 110 and the foot platform assembly 90 with the rails 156 in horizontal or substantially horizontal orientation where the rails 156 are parallel with or substantially parallel with the ground.

Advantages of the foot platform assembly 90 include:

the foot platform assembly 90 provides an alternate stepping motion that is concentric and eccentrically loaded—an alternating motion with the legs in a stepping motion to enhance balance and stepping strength;

the foot platform assembly 90 can also be used with both feet simultaneously in all the different postures and variations of squat or plyometric squat (jumping) exercises;

the foot platform assembly 90 provides for good cardio exercise;

the alternating use of the foot platform assembly 90 as a cardio exercise for a short period and then quickly using the inclinable exercise device 110 for other strength exercises, then quickly returning to the cardio and repeating, is possible;

the soft landing achieved by absorbing energy in the springs 270 of the foot platform assembly 90 reduces joint stress, allowing greater muscle exercise; and the springs 270 of the foot platform assembly 90 also allows independent walking, jogging, and like exercise with the same zero impact forces.

The above figures may depict exemplary configurations for the invention, which is done to aid in understanding the features and functionality that can be included in the invention. The invention is not restricted to the illustrated architectures or configurations, but can be implemented using a variety of alternative architectures and configurations. Additionally, although the invention is described above in terms of various exemplary embodiments and implementations, it should be understood that the various features and functionality described in one or more of the individual embodiments with which they are described, but instead can be applied, alone or in some combination, to one or more of the other embodiments of the invention, whether or not such embodiments are described and whether or not such features are presented as being a part of a described embodiment. Thus the breadth and scope of the present invention, especially in any following claims, should not be limited by any of the above-described exemplary embodiments.

Terms and phrases used in this document, and variations thereof, unless otherwise expressly stated, should be construed as open ended as opposed to limiting. As examples of the foregoing: the term "including" should be read as mean "including, without limitation" or the like; the term "example" is used to provide exemplary instances of the item in discussion, not an exhaustive or limiting list thereof; and adjectives such as "conventional," "traditional," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although item, elements or components of the disclosure may be described or claimed in the singular, the plural is contemplated to be within the scope thereof unless limitation to the singular is explicitly stated. The presence of broadening words and phrases such as "one or more," "at least," "but not limited to" or other like phrases in some instances shall not be read to mean that the narrower case is intended or required in instances where such broadening phrases may be absent.

We claim:

1. A foot platform assembly for an inclinable rebounding exercise device including at least one inclinable rail having an upper and a lower end, a sliding platform slidably mounted with respect to the at least one rail, a support base, the foot platform assembly configured to be coupled to the support base, comprising:

a pair of interconnected co-planar, side-by-side resilient, independent foot platforms, wherein the pair of resilient, independent foot platforms include springs that provide the resilient, independent foot platforms with a springy, resilient feel when a user presses and bounces off the resilient, independent foot platforms with one's feet.

2. The foot platform assembly for an exercise device of claim 1, wherein the foot platform assembly includes a spring support tube that the pair of resilient, independent foot platforms are resiliently mounted to, and a strut tube assembly for coupling the spring support tube to the exercise device.

3. The foot platform assembly for an exercise device of claim 1, wherein each foot platform includes a front foot platform member and a rear foot platform member, one of the front foot platform member and the rear foot platform member including a centrally disposed rectangular mounting section and the other of the front foot platform member and the rear foot platform member including a centrally disposed rectangular hole that receives the rectangular mounting section for mounting the front foot platform member and the rear foot platform member together, and the front foot platform member includes a front with treads to engage one's feet during use.

4. The foot platform assembly for an exercise device of claim 1, wherein the foot platform assembly includes a spring support and the springs resiliently mount the pair of resilient, independent foot platforms to the spring support.

5. The foot platform assembly for an exercise device of claim 1, further including a base support tube with a pair of tubular sockets, and the foot platform assembly includes reduced-diameter strut tubes that are received by the pair of tubular sockets.

6. The foot platform assembly for an exercise device of claim 5, wherein the foot platform assembly includes a spring support tube that the pair of resilient, independent foot platforms are resiliently mounted to, and larger-diameter strut tubes that couple the spring support tube to the reduced-diameter strut tubes.

7. The foot platform assembly for an exercise device of claim 1, wherein each foot platform includes a H-shaped tubing support assembly with H-shaped support blades.

8. The foot platform assembly for an exercise device of claim 7, wherein each foot platform includes a front foot platform member and a rear foot platform member.

9. The foot platform assembly for an exercise device of claim 1, wherein the springs are a pair of leaf springs.

10. A method of using the foot platform assembly for an exercise device of claim 1, comprising:

a. supporting each of one's feet on each of the foot platforms;

b. bending and extending at least one of one's legs, pushing off of at least one of the foot platforms with at least one of one's feet whereby at least one of the resilient, independent foot platforms provide a springy, resilient feel when the user presses and bounces off the foot platform with at least one foot.

11. The method of using the foot platform assembly for an exercise device of claim 10, wherein pushing off of at least one of the foot platforms with at least one of one's feet includes contacting both foot platforms simultaneously with one's feet.

12. The method of using the foot platform assembly for an exercise device of claim 10, wherein pushing off of at least one of the foot platforms with at least one of one's feet includes using only one foot on the foot platform assembly at a time, as opposed to two feet contacting both foot platforms simultaneously.

13. The method of using the foot platform assembly for an exercise device of claim 10, wherein pushing off of at least one of the foot platforms with at least one of one's feet includes alternating foot contact with the foot platforms whereby one foot contacts one foot platform followed by the other foot contacting the other foot platform, in a stepping motion.

14. The method of using the foot platform assembly for an exercise device of claim 10, further comprising varying resistance when pushing off of at least one of the foot platforms with at least one of one's feet by adjusting the exercise device to vary resistance.

15. The method of using the foot platform assembly for an exercise device of claim 10, wherein pushing off of at least one of the foot platforms with at least one of one's feet includes performing at least one of the following exercises: a squat exercise, a bridge squat exercise, a plyometric squat exercise, sprinters, running, jogging, and walking.

16. The method of using the foot platform assembly for an exercise device of claim 10, further comprising adjusting the exercise device to a substantially horizontal orientation, and pushing off of at least one of the foot platforms with at least one of one's feet with the exercise device in a substantially horizontal orientation.

17. The foot platform assembly for an exercise device of claim 1, wherein the foot platform assembly includes struts configured to couple the foot platform assembly to the support base.

18. The foot platform assembly for an exercise device of claim 17, wherein the foot platform assembly includes a spring support tube that together with the struts are configured to couple the foot platform assembly to the support base.

* * * * *